US010765218B2

(12) United States Patent
Donati

(10) Patent No.: US 10,765,218 B2
(45) Date of Patent: Sep. 8, 2020

(54) CHAIR OR ARMCHAIR WITH ADJUSTABLE BACKREST

(71) Applicant: DONATI S.p.A., Rodengo Saiano (IT)

(72) Inventor: Armando Donati, Rodengo Saiano (IT)

(73) Assignee: Donati S.P.A., Rodengo Saiano (IT)

( * ) Notice: Subject to any disclaimer, the term of this patent is extended or adjusted under 35 U.S.C. 154(b) by 9 days.

(21) Appl. No.: 16/301,220

(22) PCT Filed: May 23, 2017

(86) PCT No.: PCT/IB2017/053036

§ 371 (c)(1),
(2) Date: Nov. 13, 2018

(87) PCT Pub. No.: WO2017/203430

PCT Pub. Date: Nov. 30, 2017

(65) Prior Publication Data

US 2019/0208915 A1 Jul. 11, 2019

(30) Foreign Application Priority Data

May 24, 2016 (IT) ..... 102016000053316

(51) Int. Cl.

| | |
|---|---|
| ***A47C 7/40*** | (2006.01) |
| ***A47C 7/44*** | (2006.01) |
| ***A47C 1/027*** | (2006.01) |
| ***A47C 1/024*** | (2006.01) |

(52) U.S. Cl.

CPC ..... *A47C 7/443* (2013.01); *A47C 1/024* (2013.01); *A47C 1/027* (2013.01); *A47C 7/40* (2013.01); *A47C 7/402* (2013.01)

(58) Field of Classification Search

CPC ..... A47C 7/44; A47C 7/443; A47C 1/024; A47C 1/027; A47C 7/40; A47C 7/402

See application file for complete search history.

(56) References Cited

U.S. PATENT DOCUMENTS

| | | | | |
|---|---|---|---|---|
| 4,195,882 A * | 4/1980 | Daswick | A47C 7/40 | 297/242 |
| 5,868,467 A * | 2/1999 | Moll | A47C 1/032 | 297/316 |
| 7,347,496 B1 | 3/2008 | Wang | | |
| 7,396,079 B2 * | 7/2008 | Heidmann | A47C 7/405 | 297/284.4 |
| 7,665,805 B2 * | 2/2010 | Ueda | A47C 1/03255 | 297/301.1 |

(Continued)

FOREIGN PATENT DOCUMENTS

| | | |
|---|---|---|
| DE | 4432934 C1 | 2/1996 |
| JP | 3095709 U | 8/2003 |

OTHER PUBLICATIONS

International Search Report and Written Opinion for PCT/IB2017/053036 dated Sep. 14, 2017.

*Primary Examiner* — Philip F Gabler

(74) *Attorney, Agent, or Firm* — Thomas|Horstemeyer LLP

(57) ABSTRACT

A chair assembly (1) of a chair or an armchair comprises a seat body (2), a backrest body (6), a locking and adjustment device (4), and a backrest support (10). The backrest support (10) is engaged with an articulated parallelogram that allows the position of the backrest body (6) to be changed while keeping it parallel to itself. The backrest support (10) further comprises spring return means.

12 Claims, 5 Drawing Sheets

(56) References Cited

U.S. PATENT DOCUMENTS

| | | | | |
|---|---|---|---|---|
| 7,717,513 | B2 * | 5/2010 | Ueda | A47C 7/443<br>297/300.2 |
| 10,405,666 | B1 * | 9/2019 | Reus | A47C 7/506 |

* cited by examiner

CHAIR OR ARMCHAIR WITH ADJUSTABLE BACKREST

CROSS-REFERENCE TO RELATED APPLICATION

This application is the 35 U.S.C. § 371 national stage application of PCT Application No. PCT/IB2017/053036, filed May 23, 2017, where the PCT claims the priority to and benefit of Italian Patent Application No. 102016000053316, filed May 24, 2016, both of which are herein incorporated by reference in their entireties.

The object of the present invention is a chair or armchair, of the type provided with an adjustable backrest.

As is known, there are jobs that require the worker to sit for hours, sometimes in limited spaces. For example, one might think of a cashier in a supermarket sitting during the hours of the shift, but constantly moving towards the conveyor belt during code scanning operations for products, sometimes heavy ones, and then toward the cash register during payment operations.

It is therefore essential to provide workers with a comfortable seat and proper posture, first of all in order to safeguard their health, but also in terms of better working performance, linked to personal wellbeing.

For this reason, there are countless chairs with adjustable seating options that are more or less effective, such as seat height, backrest height and/or inclination.

In the specific case of the chairs provided with an adjustable inclination backrest, the Applicant has found that in the different angular positions of the backrest, the worker's back support is not always optimal.

The object of the present invention is to provide a chair or armchair with adjustable backrest that meets the above requirements and overcomes the disadvantages of the known art.

Such object is achieved by a chair according to claim 1. The dependent claims describe further embodiments of the invention.

The features and advantages of the chair according to the present invention will be apparent from the description given below, provided by way of non-limiting example, in accordance with the appended figures, wherein.

Figure 1:
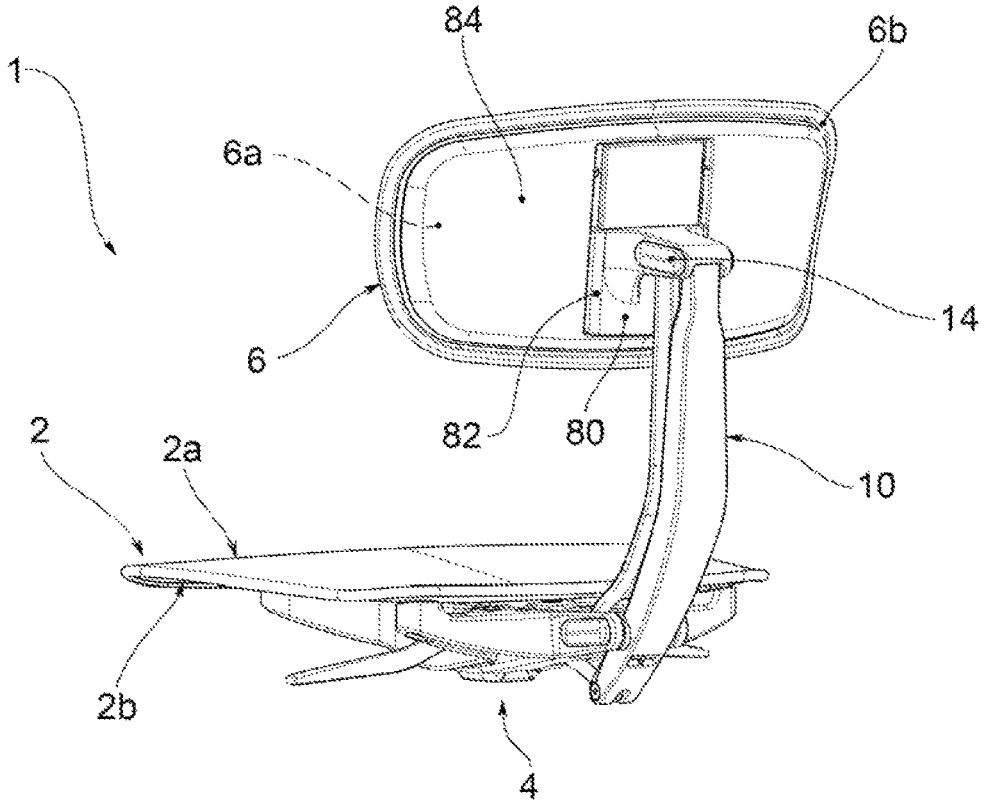
FIG. 1 shows a chair assembly according to an embodiment of the present invention, with the backrest in a raised limit configuration.
Figure 2:
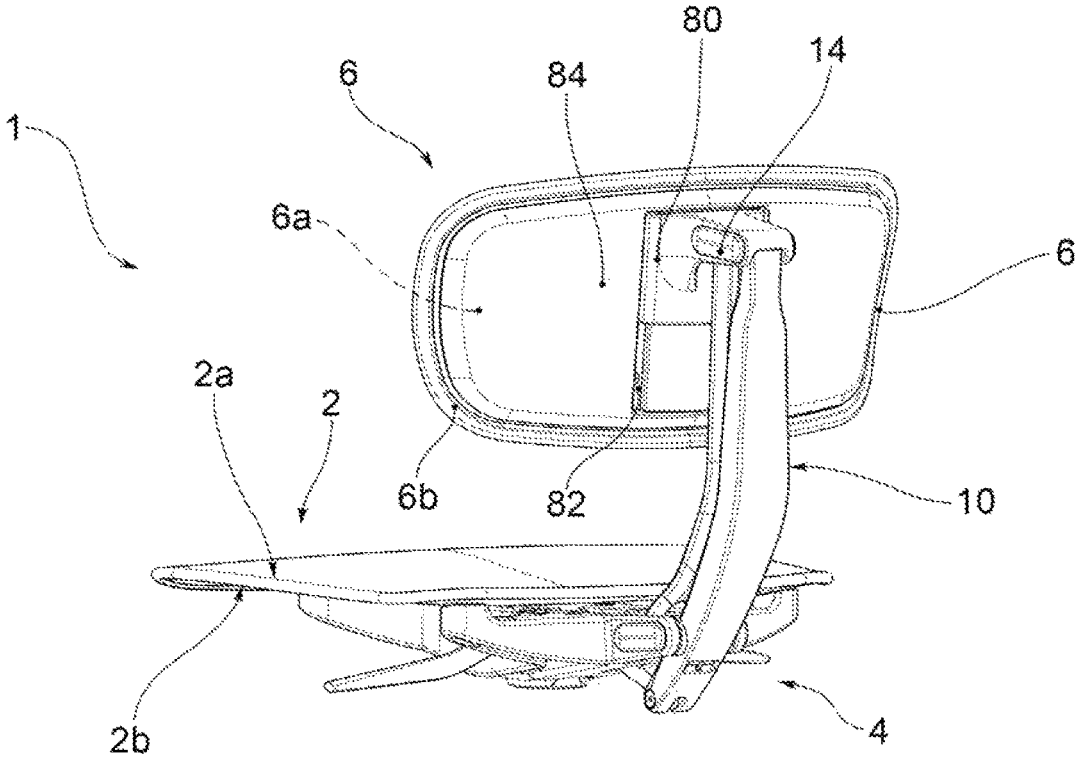
FIG. 2 shows the chair assembly of FIG. 1, with the backrest in a lowered limit configuration.

With reference to the accompanying figures, at 1 is collectively indicated a chair assembly, suitable to be applied to a support and a base, and possibly provided with armrests, to constitute a chair or an armchair.

The chair assembly 1 comprises a seat consisting of a suitably shaped seat body 2, provided with an upper face 2*a* and a lower face 2*b*, and padding (not shown) applied to the seat body 2.

The chair assembly 1 further comprises a locking and adjusting device 4, applied to the lower face 2*b* of the seat body 2.

Furthermore, the chair assembly 1 comprises a backrest consisting of a backrest body 6, provided with a front face 6*a* and a rear face 6*b*, and has padding (not shown) applied to the backrest body 6.

The chair assembly 1 further comprises a back support 10 which connects the locking and adjusting device 4 to the backrest body 6 to support it at the desired height and angular position.

The back support 10 comprises a lower engagement portion 12 attached to the seat body 2, for example part of the locking and adjusting device 4, and an upper engagement portion 14 attached to the backrest body 6 which, for example, forms a support element for the backrest body 6.

The backrest support 10 further comprises a first arm 16 or rear arm, hinged to the lower engagement portion 12 in a first lower axis 18, and a second arm 20 or anterior arm, hinged to the lower engagement portion 12 in a second lower axis 22, preferably distinct from and parallel to the first lower axis 18.

Moreover, the first arm 16 is hinged to the upper engagement portion 14 in a first upper axis 24, and the second arm 20 is hinged to the upper engagement portion 14 in a second upper axis 26, also separate and distinct from each other.

The lower engagement portion 12, the upper engagement portion 14, the first arm 16, and the second arm 20, together, provide an articulated parallelogram that allows the backrest body 6 to be positioned angularly causing it to always remain parallel to itself.

Advantageously, this makes it possible to place the backrest in different positions, in a way, however, that always provides the most suitable surface for the back so as to have optimal contact and support.

Figure 3:
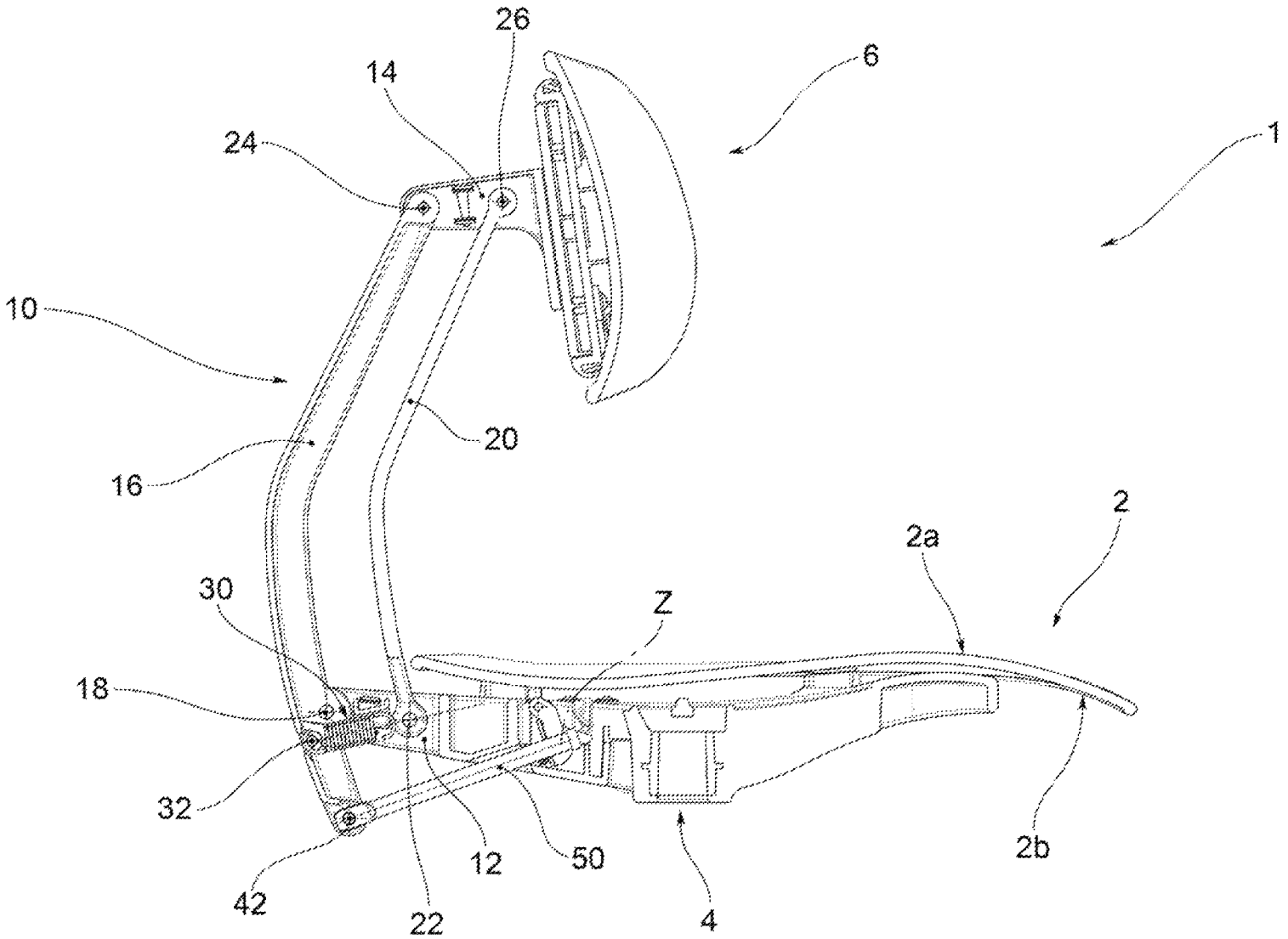
FIG. 3 illustrates a cross-sectional view of the chair assembly with the backrest in an advanced limit position.
Figure 4:
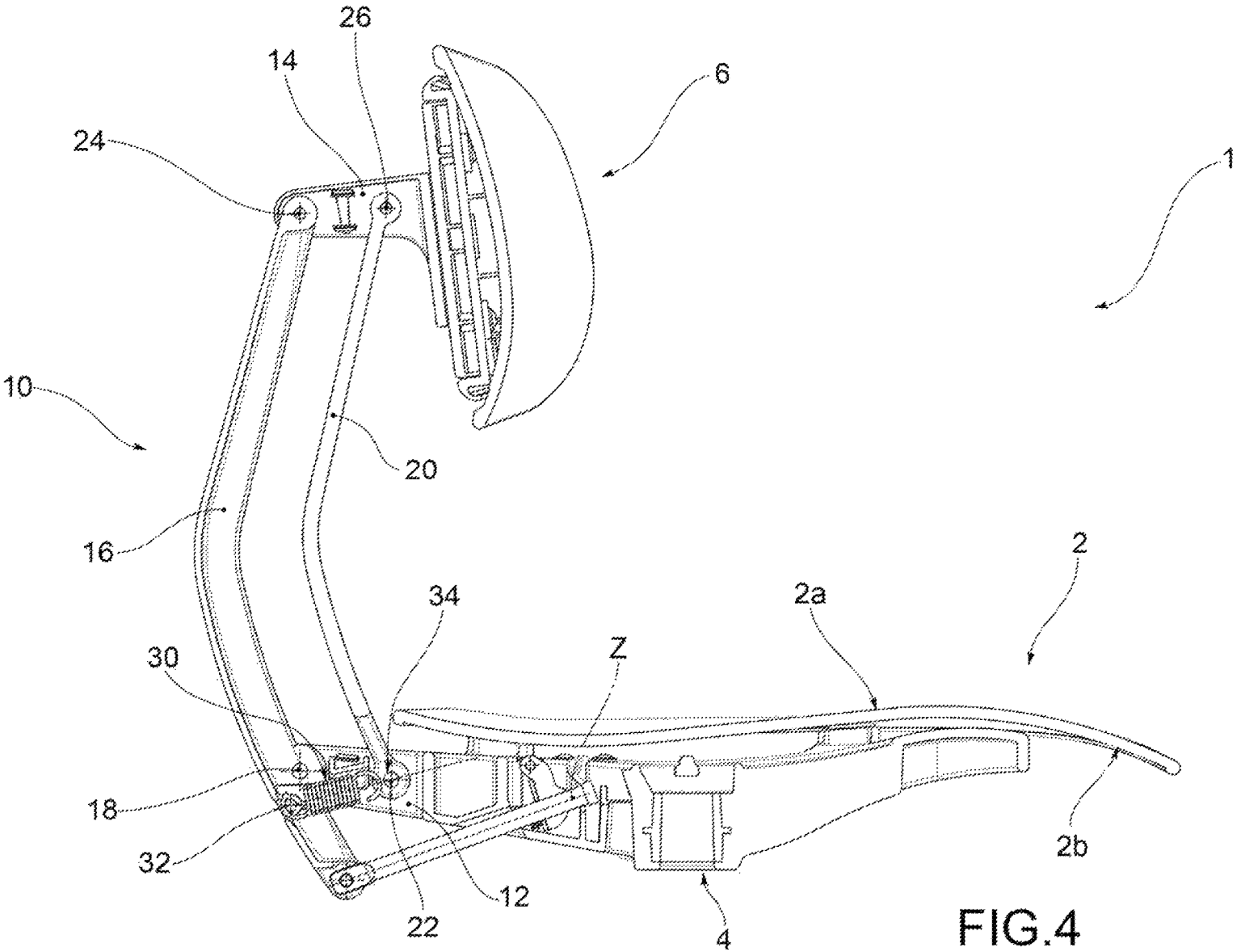
FIG. 4 illustrates a cross-sectional view of the chair assembly with the backrest in an intermediate position.
Figure 5:
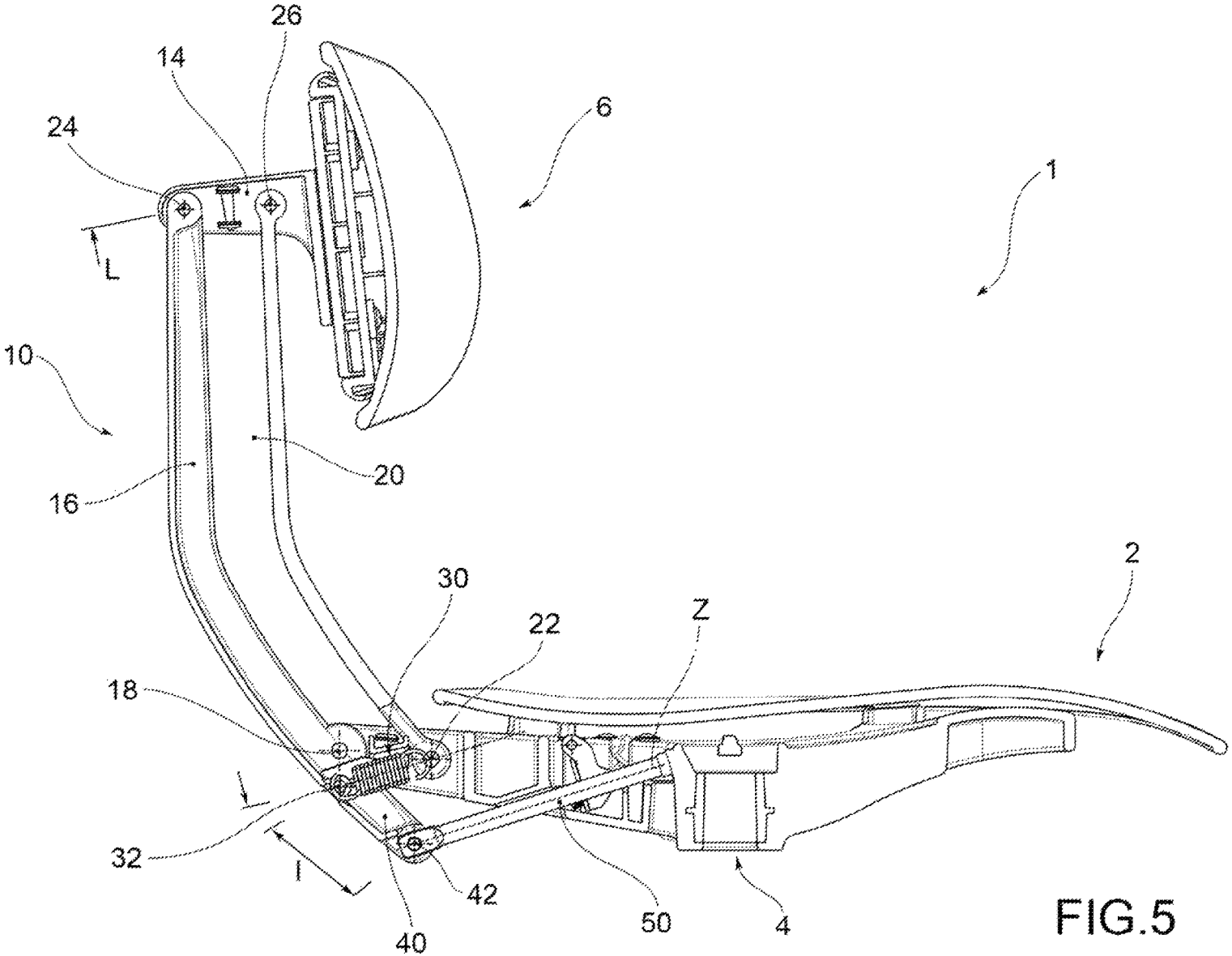
FIG. 5 illustrates a cross-sectional view of the chair assembly, with the backrest in a retracted limit position.
Figure 6:
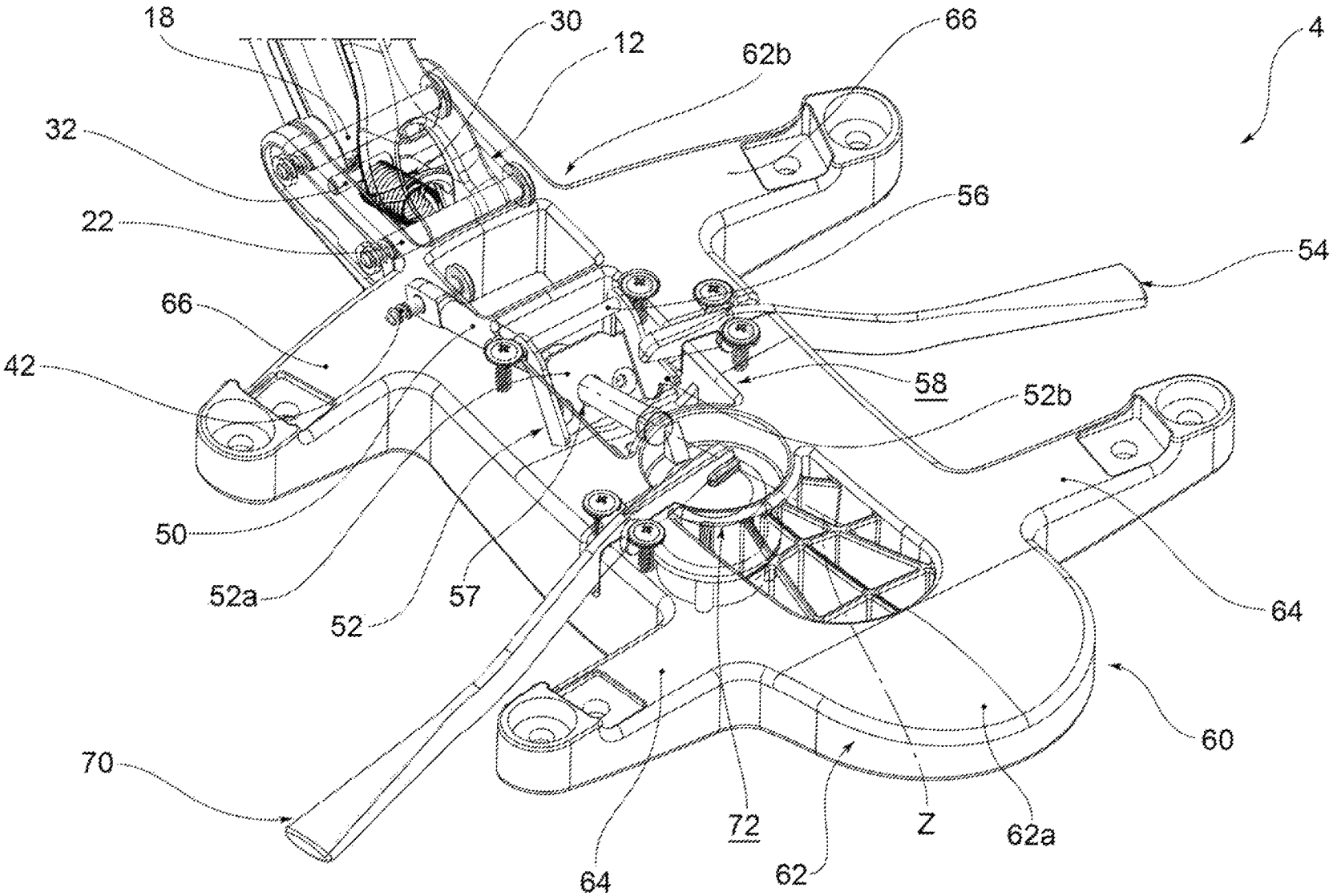
FIG. 6 is an overall view of a locking and adjusting device of the chair assembly according to an embodiment of the invention.

This is evident from the sequence of FIGS. 3, 4 and 5: in FIG. 3, the backrest support 10 is in the upper limit position, i.e. where the backrest has the greatest overlap to the seat; in FIG. 4, the backrest support 10 is in an intermediate position; in FIG. 5, the backrest support 10 is in the retracted limit position, i.e. the one in which the backrest has the least overlap with the seat. In all the positions of the backrest support 10, however, the backrest body 6 is parallel to itself.

The backrest support 10 comprises return means suitable to operate permanently to bring the backrest support 10 towards a retracted limit position.

Said return means are elastic and comprise at least one spring 30, or equivalent component, operating on one of said arms 16, 20, for example on the first arm 16.

Said spring 30, permanently in traction, is fastened to the first arm 16 at a first coupling point 32 and further coupled to a fixed stop, for example on the lower engagement portion 12, in a second coupling point 34.

Preferably, the second coupling point 34 coincides with the second lower axis 22.

Preferably, furthermore, the second coupling point 34 is separate and distinct from the first lower axis 18, and preferably placed below the same.

Preferably, furthermore, the first arm 16 has an extension 40 opposite to the end linked with the upper engagement portion 14 relative to the first lower axis 18; said extension 40 is hinged to a main bar 50 of the locking and adjusting device 4 in a locking axis 42.

Defining a longer length L, such as the distance between the first lower axis 18 and the first upper axis 24, and a shorter length 1, such as the distance between the locking axis 42 and the first lower axis 18, the L/1 characteristic ratio is preferably between 3 and 6, more preferably between 4 and 5, and preferably equal to 4.7.

Preferably, furthermore, the first coupling point 32, to which the spring 30 is coupled, is located between the locking axis 42 and the first lower axis 18.

Preferably, furthermore, the first arm 16 and the second arm 20 also have an arched, frontally concave trend, that is, towards the seat, to optimize the position of the backrest relative to the seat. This is particularly advantageous, moreover, in the advanced limit position of the backrest support.

The locking and adjusting device 4 preferably comprises a main body 60 constituted by a central portion extending longitudinally from a front end 62*a* to a rear end 62*b*, and a plurality of wings protruding transversely on one side and on the other of the central portion 62. Said wings are suitable for the mechanical connection of the main body 60 to the seat body 2 of the seat, and for the attachment of any armrests.

For example, the main body 60 has a pair of front wings 64 and a pair of rear wings 66.

Preferably, furthermore, the lower engagement portion 12 protrudes behind the central portion 62.

The locking and adjusting device 4 comprises locking means suitable to lock the backrest support 10 in a desired angular position.

Said locking means comprise the main bar 50, extending predominantly along a bar axis Z, a locking element 52, and a release lever 54.

The block element 52 is hinged to the central portion of the main body 60 in a secondary axis 56 and is provided with a through-hole 57 having a predefined hole axis; the main bar 50 crosses the block element 52 through said hole 57, dimensionally with radial play.

Preferably, furthermore, said locking element 52 is housed in a compartment 58 made in said central portion 62.

Preferably, the locking element 52 comprises a block plate 52*a*, provided with a hole 57, and an engagement flap 52*b* protruding from the locking plate 52*a* and suitable to engage with the release lever 54 to cause the rotation of the locking element 52 around the secondary axis 56.

The release lever 54, engageable with the locking element 52, is also hinged to the central portion 62 of the main body 60 and protrudes transversely between two wings 64, 66 so that it may be actuated by a user, by placing his/her hand under the seat.

In a rest configuration, the main bar 50 has a predefined position, which corresponds to a predefined angular position of the backrest support. For example, the chair assembly is in an intermediate configuration (FIG. 4).

In this rest configuration, the hole axis 57 is incident to the bar axis Z of the main bar 50, by virtue of the play between the bar and the hole 57.

Consequently, the main bar 50 is frictionally engaged in the hole 57 and therefore maintains its predefined position.

Consequently, since the main bar 50 is engaged with the backrest support 10, and in particular hinged to the first arm 16, also said backrest support is maintained in the predefined angular position.

If, from the rest configuration described above, the user, typically remaining seated, acts on the backrest by pulling it or pushing it toward the advanced limit position, the action exerted on the main bar 50 is transmitted to the locking element 52 by pulling it back, i.e. such that the hole axis 57 tends to align with the axis bar Z until the main bar 50 undergoes a translation, creeping into the hole 57 of said block element 52.

When the wearer's action on the backrest ends, the same remains in the new position, since the main bar 50, under the counter action of the return means, re-engages in the locking element 52.

If, instead of the rest configuration described above, the user, typically remaining seated, acts on the backrest by pulling it or pushing it toward the retracted limit position, the action exerted on the main bar 50 is transmitted to the locking element 52 by pushing it forward, i.e. such that the hole axis 57 tends to misalign with the axis bar Z; the main bar 50 engages therefore deeper into the hole 57 and does not undergo any translation.

Advantageously, this allows the user to quickly adjust the position of the backrest so that it is well positioned against the back.

In particular, the user, remaining seated, may bring both hands behind the backrest and push it toward the advanced limit position, thus adjusting it optimally. If, on the other hand, the user rests his/her back on the backrest and pushes it, the same does not change its position.

From the rest configuration, the actuation of the release lever 54 causes a rotation of the locking element 52 in the direction of aligning the hole axis 57 with the bar axis Z, thus allowing the sudden and free sliding of the main bar 50 into the locking element 52, under the action of the spring 30.

Consequently, the backrest support is released and is brought abruptly to the retracted limit position under the action of the return means.

Advantageously, this allows the user to release the back support by means of the release lever 50, avoiding blows to the back, since the backrest is brought back to the retracted limit position.

According to a preferred embodiment, the locking and adjusting device 4 further comprises a lever 70 for operating the seat's vertical adjustment means.

Said auxiliary lever 70 preferably protrudes transversely from the central portion 62 of the main body 60, from the opposite side relative to the release lever 50, and ends at the mouth of a vertical adjustment hole 72 through the central portion 62.

The seat's vertical adjustment means typically comprise a gas piston, intended to be inserted through the vertical adjustment hole 72, being thus engageable by the additional lever 70.

According to a preferred embodiment, furthermore, the chair assembly 1 also comprises backrest vertical adjustment means for adjusting the vertical position of the backrest.

For example, said backrest vertical adjustment means comprise said upper engagement portion 14, in which the backrest body 6 is slidably engaged, directly or indirectly.

For example, said upper engagement portion 14 comprises a plate 80 slidably inserted in guides 82 formed in an auxiliary plate 84 applied to the rear face 6*b* of the backrest body 6 or directly in the rear face of the backrest body 6.

Innovatively, the chair assembly described above allows the disadvantages of the prior art to be overcome, since it allows the optimal backrest position for the user to be maintained in any angular position of the backrest.

Advantageously, furthermore, the user, while remaining seated, may use both hands to operate the backrest, since it is not necessary to release any locking device.

According to an equivalent embodiment, the second arm of the backrest support is engaged with the main bar of the locking means.

According to a further embodiment, the spring of the return means is placed between the second arm and a fixed corresponding part.

Such variants are also contained within the scope of protection as defined by the following claims.

The invention claimed is:

1. A chair assembly for a chair or an armchair, comprising a seat body for a seat, a backrest body for a backrest, a locking and adjustment device applied to the seat body and a backrest support that connects the locking and adjustment device to the backrest body, wherein the backrest support comprises a lower engagement portion fixed to the seat body, an upper engagement portion fixed to the backrest body, a first arm, hinged to the lower engagement portion in a first lower axis and to the upper engagement portion in a first upper axis, and a second arm, hinged to the lower engagement portion in a second lower axis and to the upper engagement portion in a second upper axis, to form an articulated parallelogram that allows the position of the backrest body to be changed while keeping the backrest body parallel to the previous position, wherein the backrest support comprises return means suitable to operate permanently to bring the backrest support towards a retracted limit position, and wherein said return means are elastic and comprise at least one spring, permanently in traction, operating on one of said arms and on a fixed stop.

2. The chair assembly according to claim 1, wherein the first arm or the second arm has an extension, the extension being opposite to an end of the first or second arm linked with the upper engagement portion and relative to, respectively, the first lower axis or the second lower axis, and said extension is hinged to a main bar of locking means of the locking and adjustment device of the chair assembly, suitable to prevent free sliding of said main bar.

3. The chair assembly according to claim 1, wherein at least one of the first arm and the second arm has an arched, frontally concave trend.

4. The chair assembly according to claim 1, wherein the locking and adjustment device comprises a main body applied to the seat body.

5. The chair assembly according to claim 4, wherein said lower engagement portion is part of the main body.

6. The chair assembly according to claim 1, wherein the locking and adjustment device comprises locking means suitable to keep the backrest support in a desired angular position.

7. The chair assembly according to claim 6, wherein said locking means comprise:

a main bar having prevailing extension along a bar axis, hinged to the first arm or to the second arm;

a locking element supported in a rotatable manner and provided with a through-hole having a predefined hole axis;

a release lever operable by a user and suitable to engage the locking element to cause a rotation thereof;

wherein the main bar passes through the locking element through said hole and, in a rest configuration, the hole axis is incident to the axis of the main bar so that said main bar is stopped in the locking element, preventing its free sliding.

8. The chair assembly according to claim 7, wherein, in said rest configuration, the action exerted on the main bar, corresponding to an action on the backrest towards an advanced limit position, is transmitted to the locking element in such a way that the hole axis tends to align itself to the bar axis, until the main bar undergoes a translation, sliding in the hole.

9. The chair assembly according to claim 7, wherein, in said rest configuration, the action exerted on the main bar corresponding to an action on the backrest towards a retracted limit position, is transmitted to the locking element in such a way that the hole axis tends to further unalign itself from the bar axis, preventing the translation of the main bar.

10. The chair assembly according to claim 7, wherein, in said rest configuration, the actuation of the release lever causes a rotation of the locking element in the direction of aligning the hole axis with the bar axis, thus allowing the sudden and free sliding of the main bar into the locking element, under the action of the return means.

11. The chair assembly according to claim 1, comprising backrest vertical adjustment means for the adjustment of the vertical position of the backrest body.

12. The chair assembly according to claim 11, wherein said backrest vertical adjustment means comprise said upper engagement portion, which is slidably engaged, directly or indirectly, to the backrest body.

* * * * *